US010898017B2

(12) United States Patent
Kalisz et al.

(10) Patent No.: US 10,898,017 B2
(45) Date of Patent: Jan. 26, 2021

(54) NO-SPILL DRINKING CONTAINER

(71) Applicant: IGNITE USA, LLC, Chicago, IL (US)

(72) Inventors: Scott Kalisz, Chicago, IL (US); Paul Baird, Chicago, IL (US); Chris Sweet, Chicago, IL (US)

(73) Assignee: IGNITE USA, LLC, Chicago, IL (US)

( * ) Notice: Subject to any disclaimer, the term of this patent is extended or adjusted under 35 U.S.C. 154(b) by 40 days.

(21) Appl. No.: 16/217,771

(22) Filed: Dec. 12, 2018

(65) Prior Publication Data

US 2019/0183269 A1 Jun. 20, 2019

Related U.S. Application Data

(60) Provisional application No. 62/607,532, filed on Dec. 19, 2017.

(51) Int. Cl.

| | |
|---|---|
| ***A47G 19/22*** | (2006.01) |
| ***B65D 53/02*** | (2006.01) |
| ***B65D 51/24*** | (2006.01) |
| ***B65D 47/06*** | (2006.01) |

(52) U.S. Cl.

CPC ..... *A47G 19/2272* (2013.01); *A47G 19/2266* (2013.01); *B65D 47/065* (2013.01); *B65D 51/242* (2013.01); *B65D 53/02* (2013.01)

(58) Field of Classification Search

CPC ..... A47G 19/2272; A47G 19/2266; B65D 47/065; B65D 51/242; B65D 53/02

See application file for complete search history.

(56) References Cited

U.S. PATENT DOCUMENTS

| | | | | |
|---|---|---|---|---|
| 2010/0147862 | A1* | 6/2010 | Keefe | A47G 19/2272 220/714 |
| 2014/0144870 | A1* | 5/2014 | Brosius | A45F 3/18 215/387 |
| 2015/0173539 | A1* | 6/2015 | Mason | B65D 47/063 220/707 |
| 2016/0120343 | A1* | 5/2016 | Liang | A47G 19/2266 220/303 |
| 2016/0166094 | A1* | 6/2016 | Tebbe | A45F 3/18 220/709 |
| 2016/0200486 | A1* | 7/2016 | Meyers | B65D 47/06 215/229 |
| 2017/0007050 | A1* | 1/2017 | Parker | A47G 19/2272 |
| 2017/0251850 | A1* | 9/2017 | Coon | B65D 47/32 |
| 2018/0099805 | A1* | 4/2018 | Johnson | B65D 81/3205 |
| 2018/0192800 | A1* | 7/2018 | Coon | A47G 19/2266 |

* cited by examiner

*Primary Examiner* — James N Smalley

(74) *Attorney, Agent, or Firm* — Marshall, Gerstein & Borun LLP

(57) ABSTRACT

An easily cleanable liquid container includes a straw having a pivotably mounted internal one-way spill preventing valve and a closable drinking spout with an overmolded drinking tip. The pivotably mounted internal one-way spill preventing valve is retained in a pivotable straw nut that is pivotably attached to a straw tube, which allows easy access to internal straw components for easier cleaning. The overmolded drinking tip and a wiper seal limit the number of cracks and crevices that may collect dirt or other contaminants.

14 Claims, 7 Drawing Sheets

NO-SPILL DRINKING CONTAINER

FIELD OF THE DISCLOSURE

The disclosure relates generally to a lid assembly for liquid containers, and more particularly, to a re-closable lid assembly for liquid containers, the re-closable lid assembly allowing a consumer to drink through a spout from the liquid container while preventing accidental spills and providing easy access for cleaning.

BACKGROUND

Refillable beverage containers, such as commuter water bottles, for example, typically include a removable lid that includes a fluid aperture or drink hole, and a consumer typically fills the interior of the container (e.g., an insulated container) with a beverage (e.g., water) when the lid is removed. To drink the beverage, the consumer typically tips the container to allow the beverage to pass through the drink hole, and the consumer sips the beverage as the beverage exits the drink hole.

In some cases, a simple drink hole may be undesirable as a consumer (such as a young child or toddler) may not be sufficiently skilled to drink from the hole while not spilling. To address this problem, beverage containers with spouts were developed. Such containers include a flip out spout with a ball joint or spout base that acts as a valve to prevent fluid flow through the spout when in a closed position. When the spout is flipped out in a drinking position, the ball joint is open, allowing liquid to flow out of the container through the spout. When drinking is no longer desired, the spout can be flipped to a closed position, thereby closing the ball joint and preventing liquid from flowing out of the container. Thus, such beverage containers for children are either in the drink mode or the leak proof mode.

Other drink containers may include a straw that is manually stored in a crimped position when not in use to prevent spills. Similar to the ball joint products described above, these containers are either in the drink configuration, in which the straw is not crimped, or in the no-spill configuration, in which the straw is crimped. In any event, the user must manipulate some portion of known drink containers to transition the container between the drink configuration and the leak proof configuration.

Current spill proof water bottles have a large number of parts with many cracks and crevices allowing dirt and debris to build up without giving the consumer easy access for cleaning. Some known water bottles attempt to reduce part count and or remove or change the spill proof valve but each option introduces other issues. For example, one known water bottle includes a bite valve that does not allow for easy flushing and drying due to the bite valve design. This design causes buildup and does not yield an easy to clean product. Other products are leak proof when closed but not spill proof when in the open or drinking position.

SUMMARY

An easily cleanable liquid container includes a straw having a pivotably mounted internal one-way spill preventing valve and a closable drinking spout with an overmolded drinking sleeve. The pivotably mounted internal one-way spill preventing valve is retained in a pivotable straw nut that is pivotably attached to a straw tube, which allows easy access to internal straw components for easier cleaning. The overmolded drinking sleeve limits the number of cracks and crevices that may collect dirt or other contaminants.

DETAILED DESCRIPTION

Figure 1:
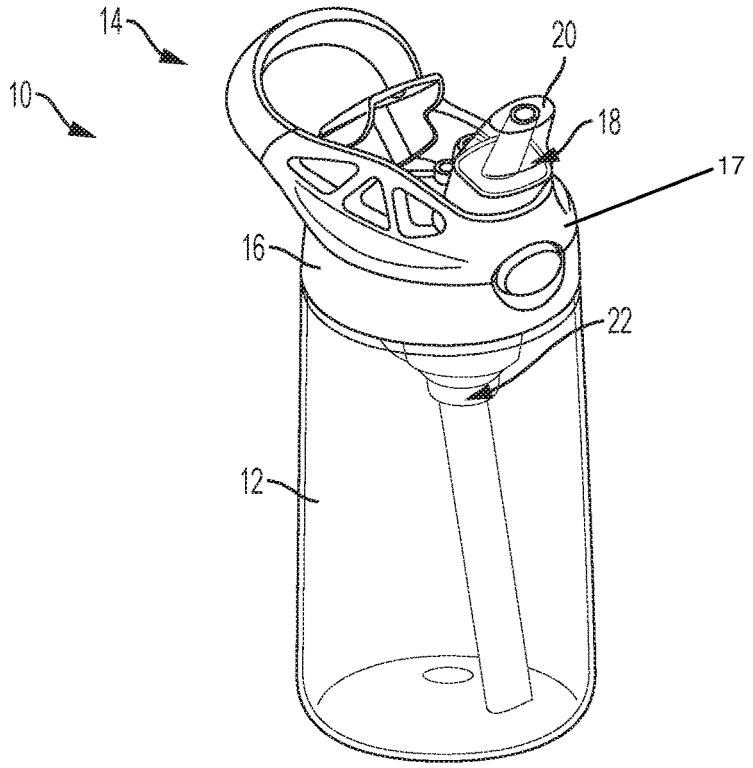
FIG. 1 is a perspective view of a drinking container including a lid assembly and a hinged valve straw according to the disclosure.
Figure 2:
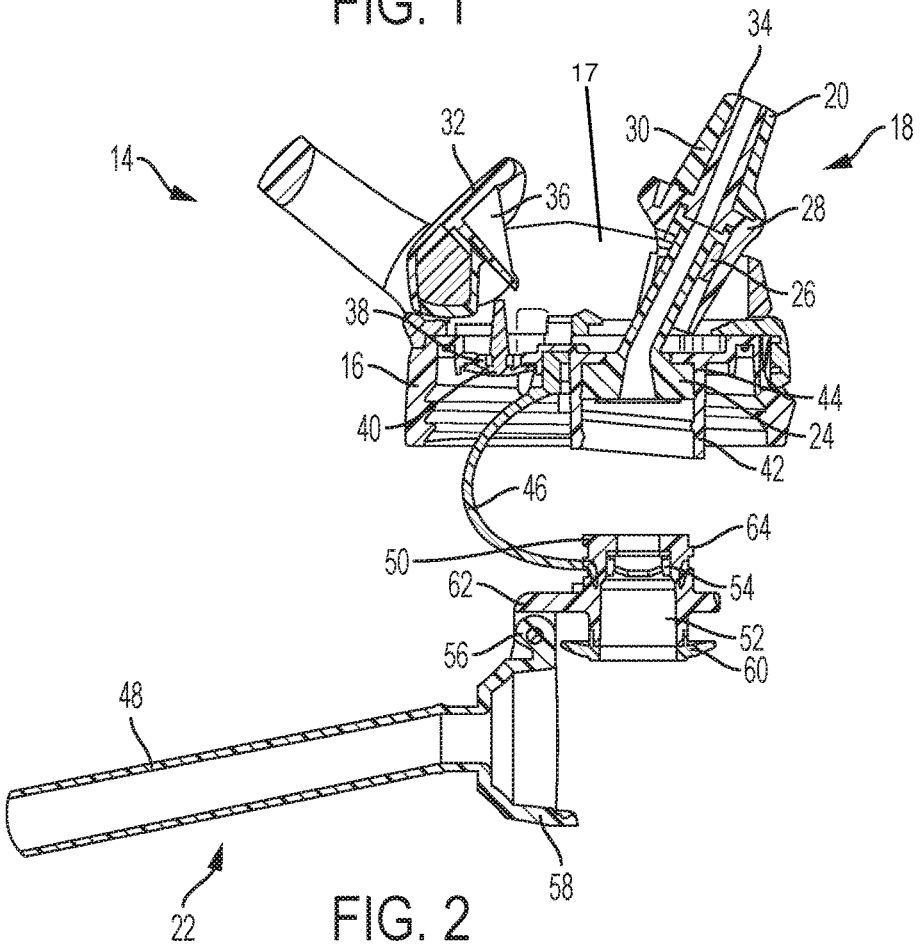
FIG. 2 is a partial exploded cross-sectional view of the lid assembly and the hinged valve straw of FIG. 1.

Turning now to FIGS. 1 and 2, a liquid container 10 includes a container body 12 and a lid assembly 14 removably attached to the container body 12. The lid assembly 14 includes a base 16 and a closable drinking spout 18 pivotably attached to a lid housing 17. An overmolded drinking tip 20 is connected to the closable drinking spout 18. A hinged valve straw 22 is connected to the base 16 to allow a user to draw liquid from the container body 12, through the hinged valve straw 22, and through the closable drinking spout 18.

The closable drinking spout 18 includes an inner flexible spout base 24, a spout nut 26, and the overmolded drinking tip 20. The overmolded drinking tip 20 includes a rigid core connector 28 and a pliable overmolded sleeve 30. By overmolding the sleeve 30 on the rigid core connector 28, the sleeve 30 is chemically bonded to the rigid core connector 28, thereby reducing the number of cracks and crevices in the drinking spout 18. As a result, the drinking spout 18 resists collection of dirt and debris and is therefore easy to clean. In the illustrated embodiment, the rigid core connector 28 and the pliable overmolded sleeve 30 both terminate at a distal end 34 of the overmolded drinking tip 20. In other embodiments one of the rigid core connector 28 and the pliable overmolded sleeve 30 may not extend completely to the distal end 34 of the overmolded drinking tip 20. For example, in other embodiments, the rigid core connector 28 may terminate between the distal end 34 of the overmolded drinking tip 20 and the inner flexible spout base 24, and the pliable overmolded sleeve 30 may continue from the terminus of the rigid core connector 28 to the distal end of the overmolded drinking tip 20. The pliable overmolded sleeve 30 forms a soft, pliable tube which provides a comfortable mouth engaging surface for a user.

A pivotable cover 32 is also attached to the lid housing 17. When the drinking tip 20 is in a closed position (not shown), the cover 32 receives the distal end 34 of the drinking tip 20 in a recess 36, which protects the drinking tip 20 from dirt and debris while holding the drinking tip 20 in the closed position.

The base 16 includes a pressure opening 38 and a pressure relief valve 40 is located in the pressure opening 38. The pressure relief valve 40 allows pressure inside of the container 12 to equalize with the atmospheric pressure when the drinking tip 20 is in the open position. Equalization of the internal pressure prevents a vacuum from forming within container 12.

An inner side of the base 16 includes an internally threaded straw well 42. The spout base 24 includes a skirt or annular flange 44 that fits within the straw well 42 and secures the spout base 24 to the base 16. The internal threads of the straw well 42 are sized and shaped to receive a portion of the hinged valve straw 22, which will be discussed further below.

The hinged valve straw 22 includes a straw tube 48, and a pivotable collar or straw nut 50. The straw nut 50 has a through bore 52 and a one way valve 54 located in the through bore 52. The one way valve 54 allows fluid to be drawn from the container body 12 to the drinking spout 20 when a user creates sufficient suction to open the one way valve 54 by sucking on the drinking tip 20, but prevents liquid flow in the reverse direction when sufficient suction is not produced. The one way valve 54 prevents fluid from exiting the drinking tip 20 by the force of gravity alone, even if the drinking tip 20 is in the open position.

When the hinged valve straw 22 is disconnected from the straw well 42, the hinged valve straw 22 remains connected to the base 16 by a tether 46. The tether allows the hinged valve straw 22 to be separated from the base 16 for easy cleaning while preventing the hinged valve straw 22 from being lost during the cleaning process.

Figure 6A:
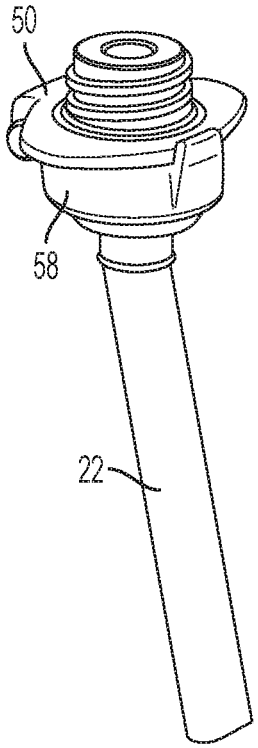
FIG. 6A is a side perspective view of the hinged valve straw of FIG. 1, with a hinged valve in a closed position.

The straw nut 50 is attached to the straw tube 48 by a hinge pivot 56. The hinge pivot 56 allows the straw nut 50 to pivot between an open position, which is illustrated in FIG. 2 and a closed position, which is illustrated in FIG. 6A. This opening ability allows a user easy access to both sides of the one way valve 54 for complete cleaning. Opening the straw nut 50 also allows easier cleaning of the straw tube 48.

The straw tube 48 may include a receiver cup 58 that is shaped to receive an inner end of the straw nut 50. A wiper seal 60 is disposed on the inner end of the straw nut 50, the wiper seal 60 being formed as a cone-shaped annular ring that seals against an inner surface of the receiver cup 58 when the straw nut 50 is in the closed position.

The straw nut 50 includes threads 64 at an outer end opposite the wiper seal 60. The threads 64 cooperate with the threads on the inner surface of the straw well 42 to removably secure the hinged valve straw 22 to the base 16.

The straw nut 50 includes an annular flange or collar 62 that joins the hinge pivot 56, thereby allowing additional clearance for the straw nut 50 when the straw nut 50 is opened.

Figure 3:
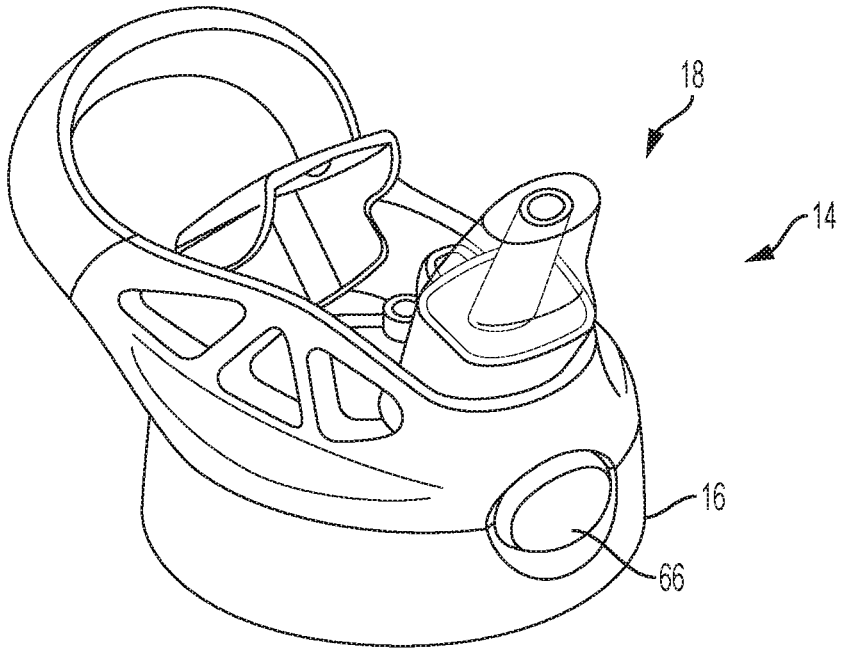
FIG. 3 is a top perspective view of the lid assembly of FIG. 1.
Figure 4:
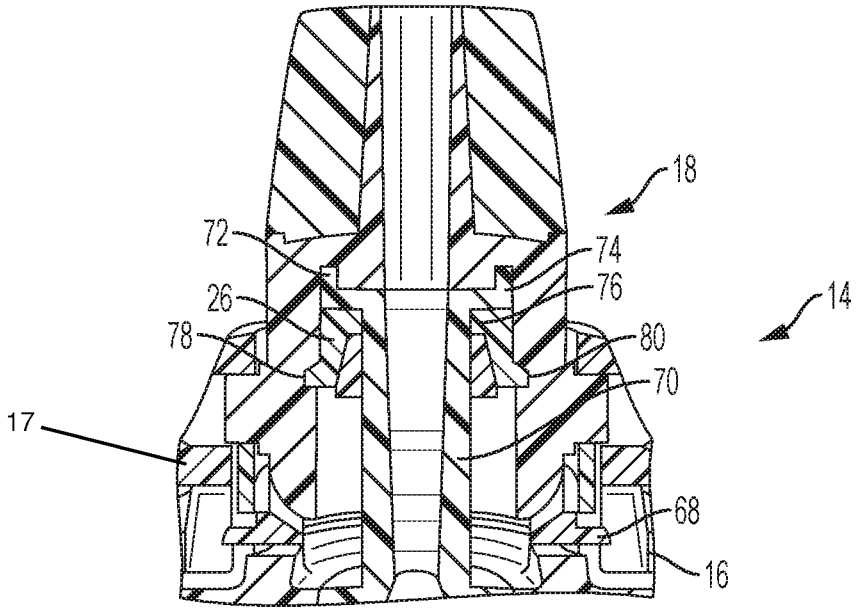
FIG. 4 is a lateral cross-sectional view of the lid assembly of FIG. 3.

Turning now to FIGS. 3 and 4, the lid assembly 14 is illustrated. As discussed previously, the lid assembly 14 includes the base 16 and the closable drinking spout 18 pivotably attached to the lid housing 17. A locking mechanism, such as a push-button 66, secures the closable drinking spout 18 in the closed position. When a user desires to change the open the closable drinking spout 18, the push-button 66 is pushed, thereby allowing an internal lock 68 to disengage while the closable drinking spout 18 changes position. When the closable drinking spout 18 is in the open desired position, the closable drinking spout 18 is held in the open position by elastic nature of a central tube 70. In some embodiments, the closable drinking spout 18 may be formed of any elastic material, such as silicone.

The spout base 24 includes the central tube 70 and a spout flange 72. The spout flange 72 fits within an annular tube recess 74 that is formed in the core connector 28. The spout nut 26 includes an internal flange 76 at one end that is sized to slide over the central tube 70. The spout nut 26 includes an external flange or skirt 78 at another end, the skirt 78 being radially flexible so that the ends of the skirt 78 form one or more retention tabs that can slide within a central bore of the core connector 28 during assembly and extend outward, into an annular channel 80 in the core connector 28 to secure the core connector 28 to the spout base 24 when fully assembled.

Figure 5A:
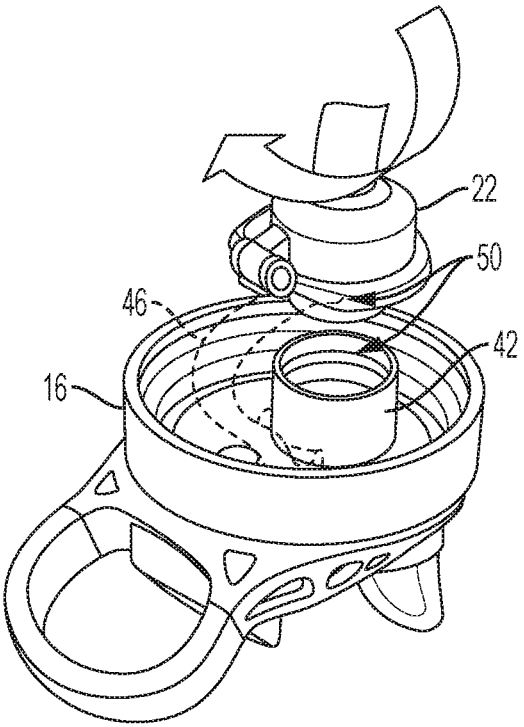
FIG. 5A is a bottom perspective view of the lid assembly of FIG. 3 and the hinged valve straw of FIG. 1, with the hinged valve straw being in an unconnected, but tethered state.
Figure 5B:
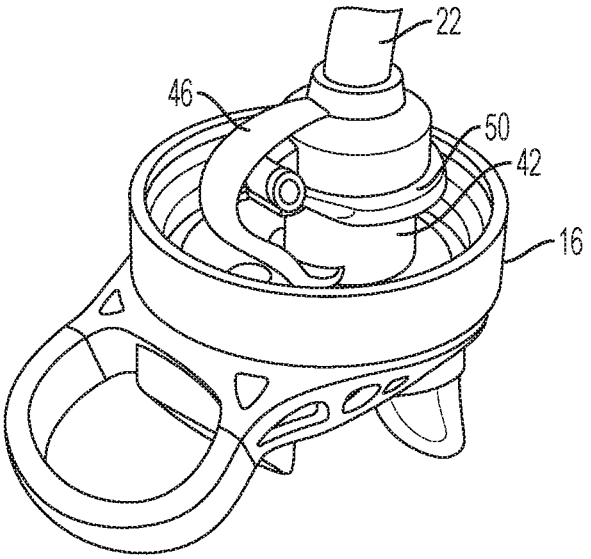
FIG. 5B is a bottom perspective view of the lid assembly of FIG. 3 and the hinged valve straw of FIG. 1, with the hinged valve straw being in a connected state.

Turning now to FIGS. 5A and 5B, the hinged valve straw 22 is illustrated in an unconnected position in FIG. 5A and a connected position in FIG. 5B. In the unconnected position, the hinged valve straw 22 is separated from the base 16 for easy cleaning while remaining tethered to the base 16 by the tether 46 to prevent loss of the hinged valve straw 22 during cleaning. In the connected position, the hinged valve straw 22 is connected to the base by the valve nut 50 and the straw well 42.

Figure 6B:
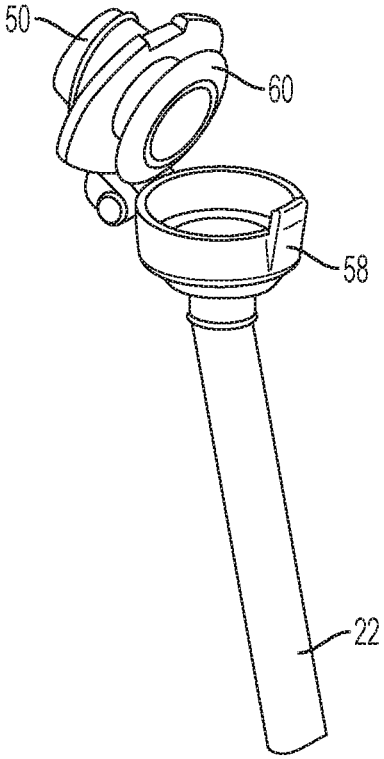
FIG. 6B is a side perspective view of the hinged valve straw of FIG. 1, with the hinged valve in an open position.
Figure 6C:
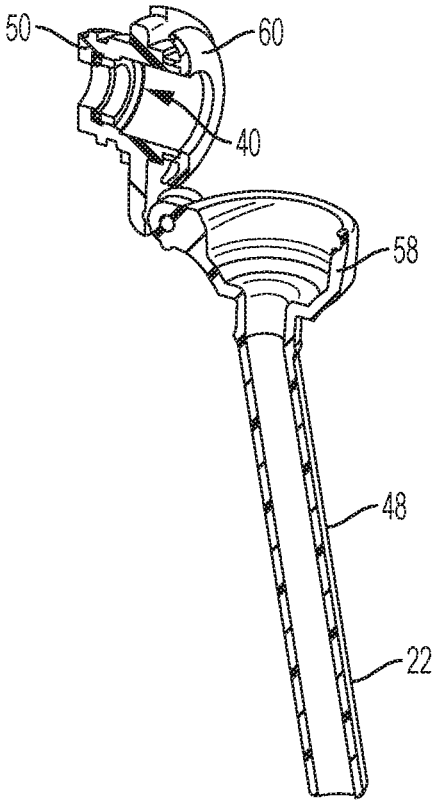
FIG. 6C is a side cross-sectional view of the hinged valve straw of FIG. 6B.

Turning now to FIGS. 6A-6C, the hinged valve straw 22 is illustrated in a closed position (FIG. 6A) and in an open position (FIGS. 6B and 6C). In the closed position, an inner end of the valve nut 50 is disposed in the receiver cup 58. In the open position, the inner end of the valve nut 50 is exposed, resulting in easy access to the wiper seal 60 and to the inside of the valve 40. Furthermore, in the open position, the straw tube 48 is easily flushable for cleaning.

Figure 7:
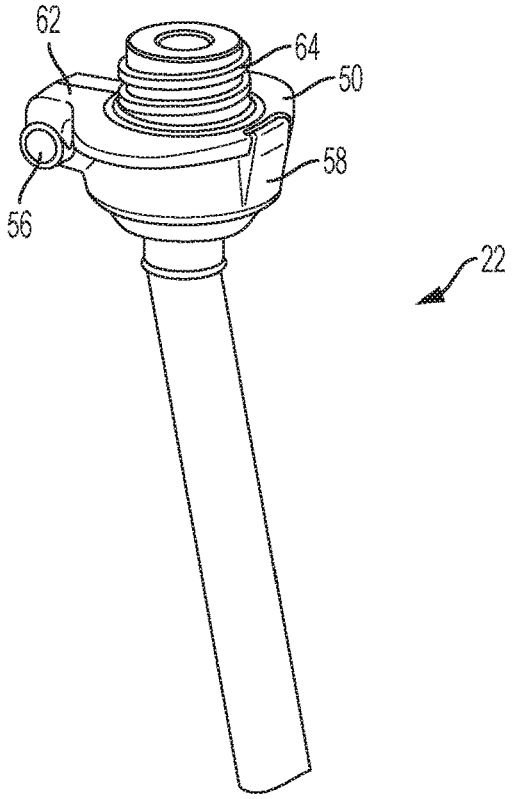
FIG. 7 is a close up side perspective view of the hinged valve straw of FIG. 6A.

Turning now to FIG. 7, the hinged valve straw 22 is illustrated. The valve nut 50 is in the closed position. The collar 62 forms a stop that seats the valve nut 50 against the upper edge of the receiver cup 58. The collar 62 also forms a stop that seats against the straw well 42, as will be discussed further below. The threads 64 extend upward, away from the collar 62.

Figure 8A:
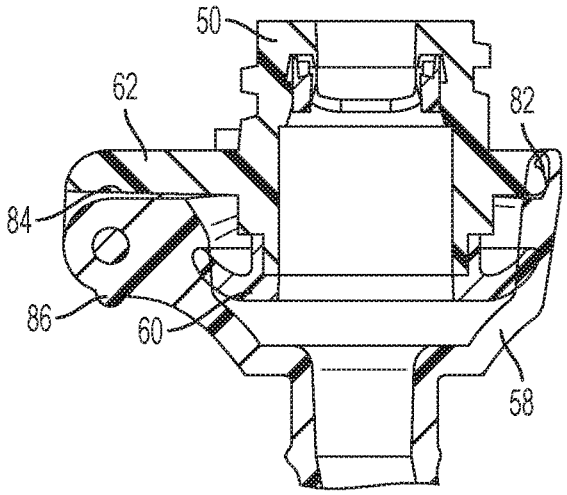
FIG. 8A is a side cross-sectional view of the hinged valve of FIG. 6A, with the hinged valve in a closed position.
Figure 8B:
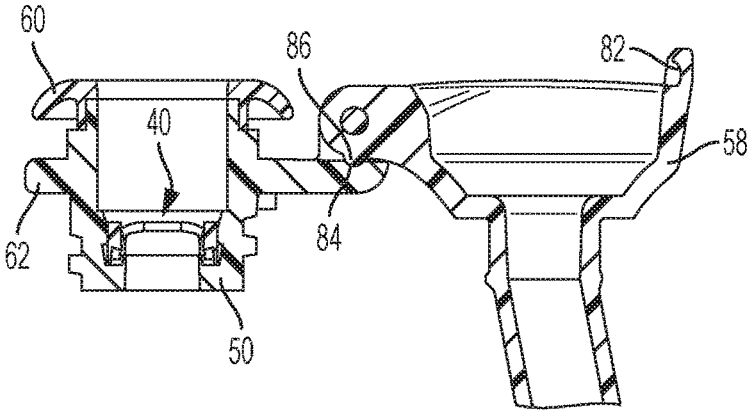
FIG. 8B is a side cross-sectional view of the hinged valve of FIG. 6B, with the hinged valve in a fully open position.

Turning now to FIGS. 8A and 8B, the valve nut 50 and the receiver cup 58 include an open detent and a closed detent. More specifically, an inner surface of the receiver cup 58 includes a cup recess 82 that is sized and shaped to receive a portion of the collar 62 when the valve nut 50 is in the closed position (FIG. 8A), thereby forming a closed detent. Similarly, the bottom surface of the collar 62 includes a collar recess 84 that is sized and shaped to receive a cup protrusion 86 (FIG. 8B), thereby forming an open detent. The detents retain the valve nut 50 in the desired position, but are easily disengaged without the need for tools by a user.

Figure 9A:
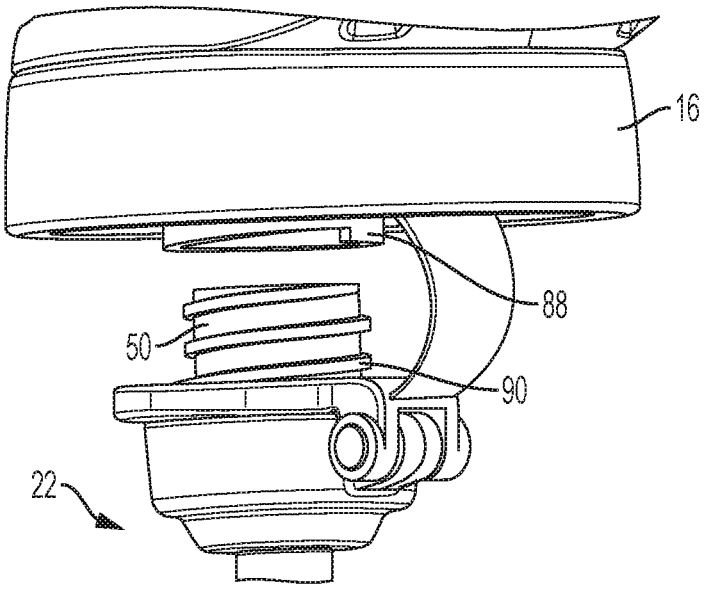
FIG. 9A is a close up side view of the hinged valve straw and the lid assembly of FIG. 1, with the hinged valve straw being in an unconnected, but tethered position.
Figure 9B:
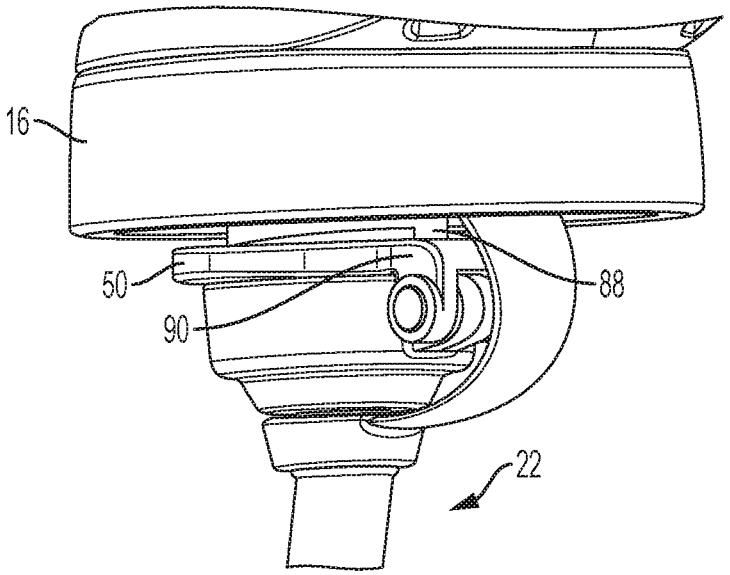
FIG. 9B is a close up side view of the hinged valve straw and the lid assembly of FIG. 1, with the hinged valve straw being in a connected position.

Turning now to FIGS. 9A and 9B, the straw well 42 and the valve nut 50 include stops that prevent over-tightening of the valve nut 50 when the hinged valve straw 22 is secured to the base 16. More specifically, the straw well 42 includes a base stop 88 and the valve nut 50 includes a nut stop 90. The base stop 88 and the nut stop 90 are longitudinal shoulders that meet when the valve nut 50 is fully seated in the straw well 42. The base stop 88 and the nut stop 90 provide a physical barrier to further tightening of the valve nut 50, which prevents a user from over-tightening and potentially over compressing the base skirt 44.

Figure 10:
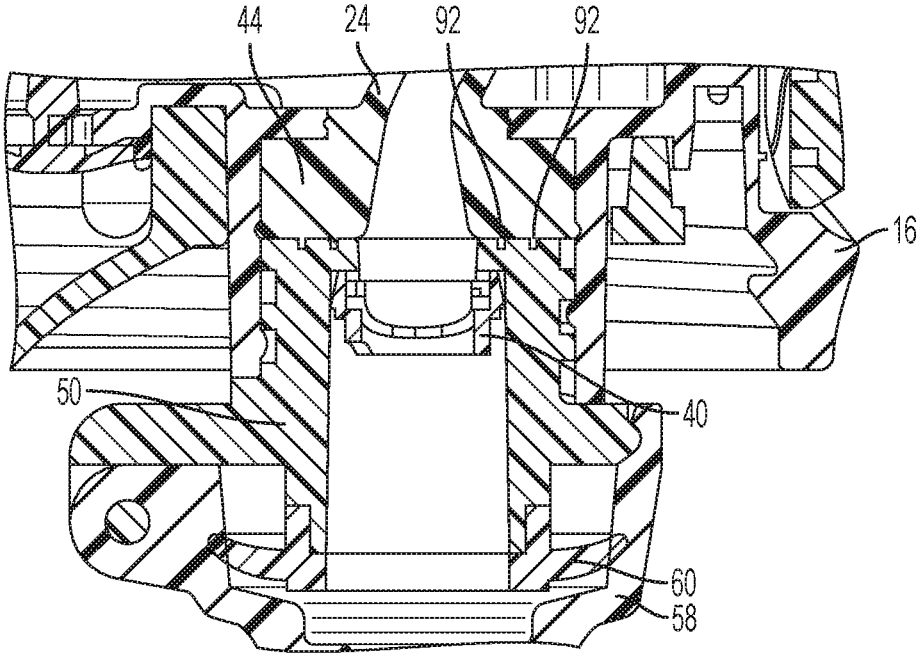
FIG. 10 is a close up cross-sectional view of the hinged valve straw and the lid assembly of FIG. 9B.

Turning now to FIG. 10, the base skirt 44 of the spout base 24 may include a plurality of seal protrusions 92 that enhance sealing between the spout base 24 and the valve nut 50 when the valve nut is in the closed position. The seal protrusions 92 are formed as one or more annular rings that extend from a bottom surface of the base skirt 44.

In some embodiments, the pliable sleeve may be formed from a nylon/silicone overmold. In other embodiments, other pliable overmoldable materials may be used. In yet other embodiments, the spout may be formed as one piece made from a hard plastic, such as nylon, without the pliable sleeve.

In the disclosed embodiment, the pivotable valve straw is held together by a pivot pin and tether to prevent loss of the separate parts. In other embodiments, the parts of the pivotable valve straw could be separated out into loose components. In other embodiments, the wiper seal may be formed as an o-ring or face seal.

Known drinking containers are not easy to clean and contain many uncleanable cracks and crevices. The disclosed container reduces the number of cracks and crevices that capture dirt, debris, and contaminants, and the disclosed container also provides easy access to internal parts to allow a more thorough cleaning.

The disclosed hinged valve straw requires no tools to open and allows easy access to the internal valve for a more thorough cleaning. The disclosed pivotable valve straw is opened with a simple twist and pop motion.

The disclosed container features easy flushability through all drink channel paths. The disclosed container reduces the amount and severity of wells or dead-zones that are difficult to access or flush.

The disclosed container includes the overmolded spout, which reduces the number of inaccessible cracks and crevices, thereby improving cleanability. The hinged valve straw and wiper seal allow the user easy and quick access to internal components for easier cleaning.

While various embodiments have been described above, this disclosure is not intended to be limited thereto. Variations can be made to the disclosed embodiments that are still within the scope of the appended claims.

What is claimed is:

1. A liquid container comprising:

a container body;

a base removably attached to the container body, the base comprising a closable drinking spout and an overmolded drinking tip; and a hinged valve straw connected to the base, wherein the hinged valve straw includes a straw nut that contains a one-way spill preventing valve, and the straw nut is pivotably connected to a straw tube by a collar.

2. The liquid container of claim 1, wherein the hinged valve straw is tethered to the base.

3. The liquid container of claim 1, wherein the straw nut includes a wiper seal at one end and threads at an opposite end.

4. The liquid container of claim 1, further comprising a stop mechanism that limits rotational movement between the hinged valve straw and the base.

5. The liquid container of claim 4, wherein the stop mechanism includes a nut stop and a well stop.

6. The liquid container of claim 5, wherein one of the nut stop and the well stop are formed as a shoulder.

7. The liquid container of claim 1, wherein the closable drinking spout includes a spout nut.

8. The liquid container of claim 7, wherein the spout nut includes a plurality of retention tabs.

9. The liquid container of claim 8, wherein the overmolded drinking tip is secured to the closable drinking spout by the spout nut.

10. A hinged valve straw for a drinking container, the hinged valve straw comprising:

a straw tube; and a straw nut disposed at one end of the straw tube, the straw nut including a through bore and a one way valve disposed within the through bore, the straw nut being hingedly connected to the straw tube, wherein the straw nut is pivotably connected to the straw tube by a collar.

11. The hinged valve straw of claim 10, wherein the one way valve is contained within the collar.

12. The hinged valve straw of claim 11, further comprising a wiper seal disposed on one end of the collar, the wiper seal being located between the collar and the straw tube when the collar is in a closed position.

13. The hinged valve straw of claim 12, wherein the collar further comprises a ledge that forms a closed detent with the straw tube.

14. The hinged valve straw of claim 13, wherein the collar further includes a recess that forms an open detent with the straw tube.

* * * * *